US007077194B2

(12) United States Patent
Wisniewski et al.

(10) Patent No.: US 7,077,194 B2
(45) Date of Patent: Jul. 18, 2006

(54) BRAZED CONDENSER JUMPER TUBE

(75) Inventors: Christopher Wisniewski, Livonia, MI (US); Michael Tucker, Livonia, MI (US)

(73) Assignee: Denso International America, Inc., Southfield, MI (US)

( * ) Notice: Subject to any disclaimer, the term of this patent is extended or adjusted under 35 U.S.C. 154(b) by 141 days.

(21) Appl. No.: 10/787,865

(22) Filed: Feb. 26, 2004

(65) Prior Publication Data

US 2005/0189098 A1 Sep. 1, 2005

(51) Int. Cl.
*F28F 9/04* (2006.01)

(52) U.S. Cl. ..... 165/178; 165/153; 165/173

(58) Field of Classification Search ..... 165/153, 165/173, 175, 176, 178
See application file for complete search history.

(56) References Cited

U.S. PATENT DOCUMENTS

| | | | | |
|---|---|---|---|---|
| 2,082,584 | A | 6/1937 | Magis | |
| 4,441,547 | A | 4/1984 | Argyle et al. | |
| 4,887,666 | A | 12/1989 | Briet | |
| 5,163,716 | A * | 11/1992 | Bolton et al. | 285/142.1 |
| 5,186,245 | A | 2/1993 | Peters | |
| 5,209,290 | A | 5/1993 | Chigira | |
| 5,224,537 | A | 7/1993 | Potier | |
| 5,348,079 | A | 9/1994 | Tanaka | |
| 5,711,370 | A * | 1/1998 | Tanaka | 165/178 |
| 5,771,965 | A * | 6/1998 | Inaba et al. | 165/178 |
| 5,911,274 | A | 6/1999 | Inaba et al. | |
| 5,941,304 | A | 8/1999 | Inaba et al. | |
| 5,975,193 | A | 11/1999 | Tokita et al. | |
| 6,065,534 | A * | 5/2000 | Sircar | 165/178 |
| 6,154,960 | A * | 12/2000 | Baldantoni et al. | 29/890.054 |
| 6,199,622 | B1 | 3/2001 | Mashio et al. | |
| 6,276,447 | B1 | 8/2001 | Iguchi et al. | |
| 6,546,997 | B1 | 4/2003 | Inaba et al. | |
| 6,557,373 | B1 | 5/2003 | Nitta | |
| 6,609,558 | B1 | 8/2003 | Charbonnelle | |
| 2001/0010263 | A1 | 8/2001 | Ichiyanagi | |
| 2002/0050348 | A1 | 5/2002 | Watanabe et al. | |
| 2003/0127214 | A1 | 7/2003 | Sugimoto et al. | |
| 2003/0177775 | A1 | 9/2003 | Wanami et al. | |

FOREIGN PATENT DOCUMENTS

| | | |
|---|---|---|
| JP | 9-178388 | 7/1997 |

* cited by examiner

*Primary Examiner*—Teresa J. Walberg
(74) *Attorney, Agent, or Firm*—Harness, Dickey & Pierce, PLC

(57) ABSTRACT

A jumper tube assembly for a heat exchanger includes a first connector block having an attachment portion engaged to the heat exchanger, an outlet and an inlet for receiving refrigerant from the heat exchanger. A second connector block includes an attachment portion engaged to the heat exchanger, an inlet and an outlet. A jumper tube extends between the first and the second connector block. The jumper tube includes an inlet connected to the outlet of the first connector block and an outlet connected to the inlet of the second connector block. The jumper tube inlet and the jumper tube outlet are brazed to the respective first and second connector blocks. The first and second connector blocks are brazed to the heat exchanger.

16 Claims, 6 Drawing Sheets

BRAZED CONDENSER JUMPER TUBE

FIELD OF THE INVENTION

The present invention relates to HVAC systems in vehicles and more particularly to a jumper tube assembly for a condenser of a refrigerant cycle for a vehicle air conditioner.

BACKGROUND OF THE INVENTION

In automotive vehicles, it is common to have a climate control systems to keep passenger comfort. Typically climate control systems consist of heating and cooling systems. Typically, a heat exchanger called a condenser is included as part of the cooling system for performing heat exchange with the outside air. Heat exchange may be facilitated by a fan to cool refrigerant into a liquid in the condenser.

Sometimes condensers are provided with jumper tubes for routing fluid from the outlet of the condenser to the connection point of the air conditioning (A/C) plumbing. From the connection point, the fluid may be routed by the A/C plumbing to a desired location such as to a receiver for separating refrigerant into a gas and a liquid. Since heat exchange is desired with the outside air, the engine compartment of the vehicle is generally used to accommodate the condenser. Because of packaging considerations, it is desirable to route the A/C plumbing, as well as the jumper tube, in an efficient configuration. Similarly, it is desirable to provide a convenient assembly process for mounting the plumbing to the condenser in an efficient manner.

SUMMARY OF THE INVENTION

A jumper tube assembly for a heat exchanger includes a first connector block having an attachment portion engaged to the heat exchanger, an outlet and an inlet for receiving refrigerant from the heat exchanger. A second connector block includes an attachment portion engaged to the heat exchanger, an inlet and an outlet. A jumper tube extends between the first and the second connector block. The jumper tube includes an inlet connected to the outlet of the first connector block and an outlet connected to the inlet of the second connector block. The jumper tube inlet defines a first axis and the jumper tube outlet defines a second axis. The first axis is substantially parallel to the second axis.

According to other features, the jumper tube includes an upstream portion extending along the first axis for carrying refrigerant away from the first connector block. A downstream portion of the jumper tube extends along a second axis for carrying fluid to the second connector block. An intermediate portion extends between the upstream and downstream portions and defines an intermediate axis intersecting the first and second axis. The jumper tube inlet and the jumper tube outlet are brazed to the respective first and second connector blocks. The first and second connector blocks are brazed to the heat exchanger.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
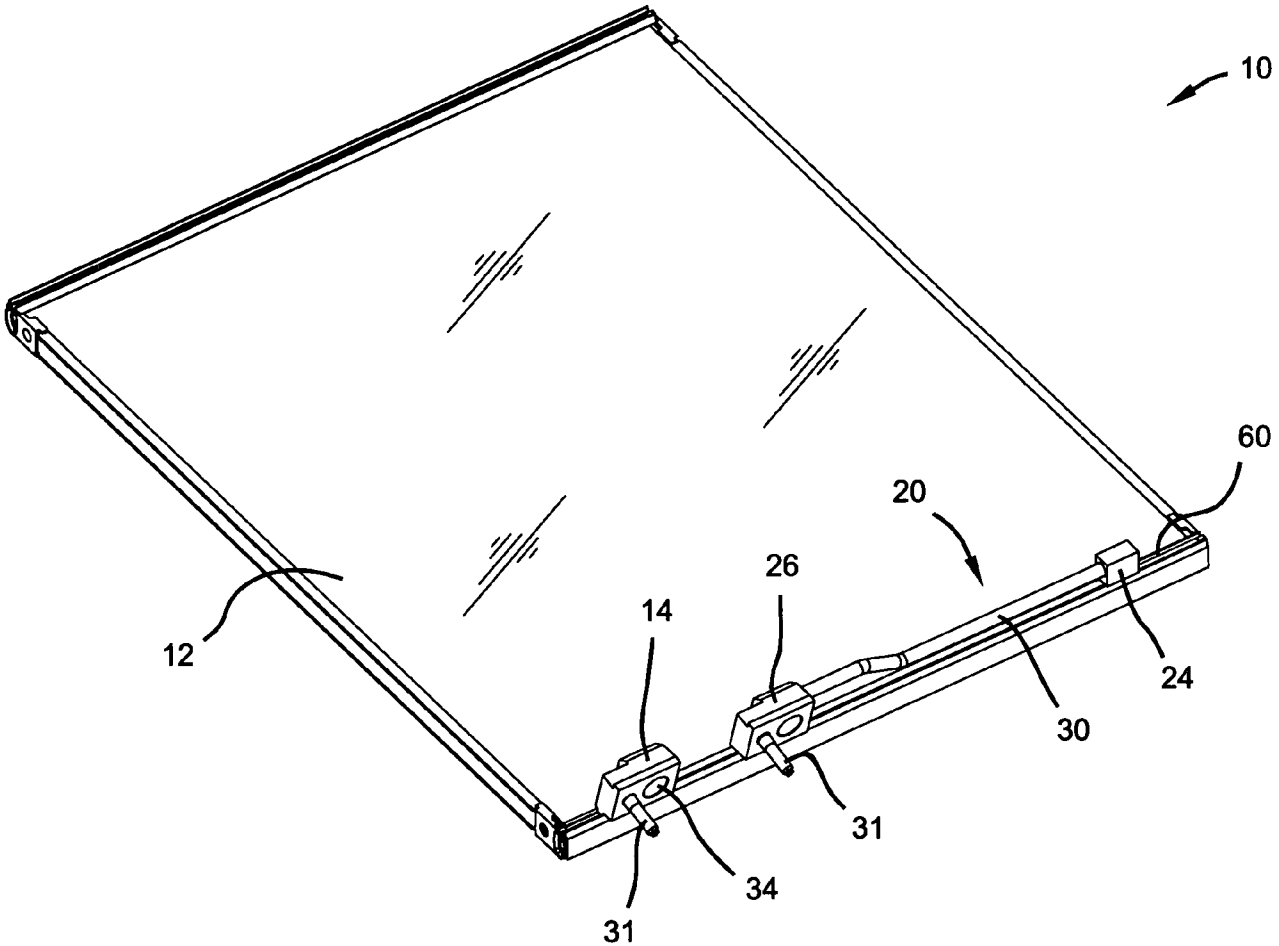
FIG. 1 is a front perspective view of a jumper tube assembly cooperating with a condenser assembly of an A/C system of a vehicle according to the present teachings.
Figure 2:
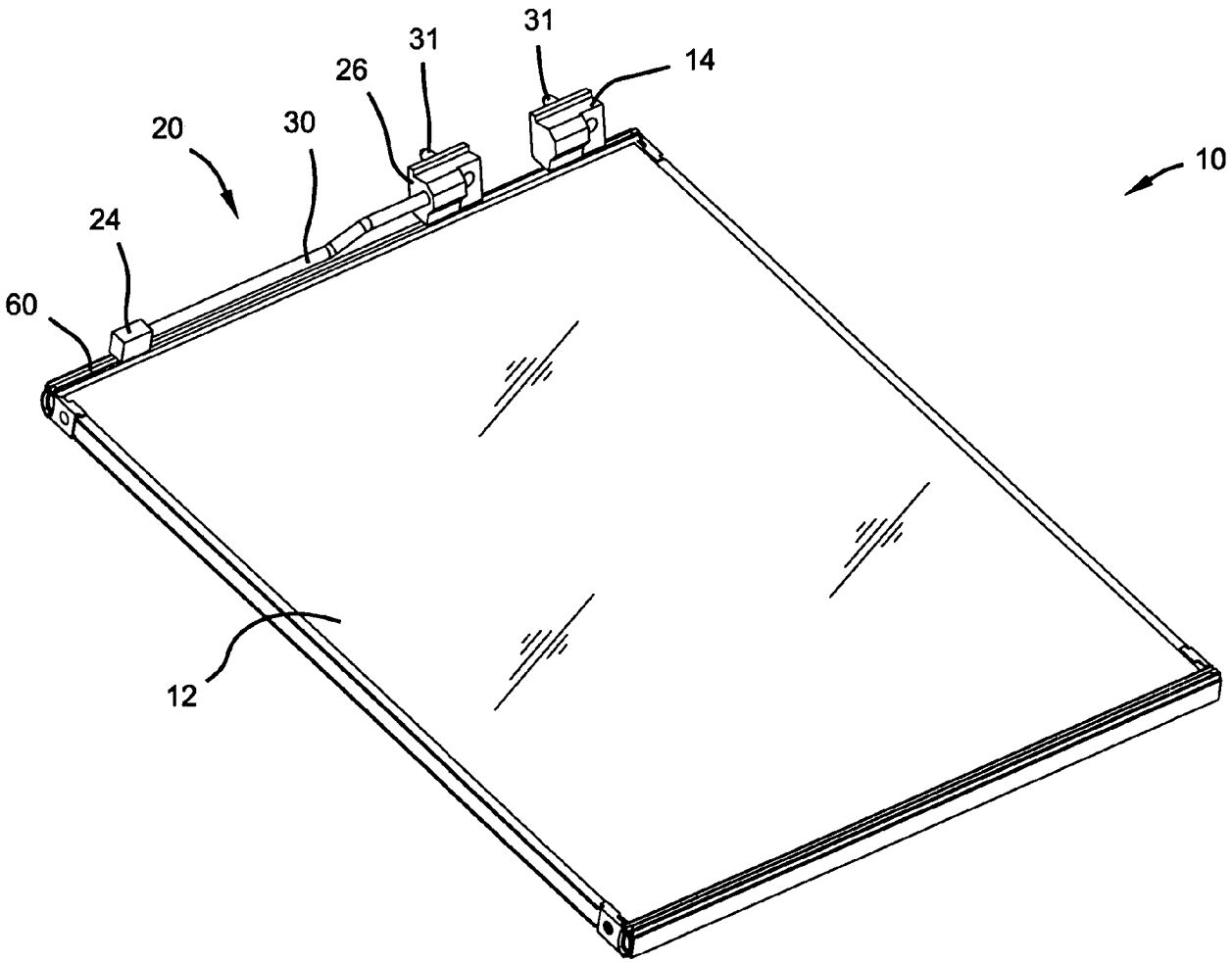
FIG. 2 is a rear perspective view of the jumper tube assembly of FIG. 1.

With initial reference to FIGS. 1 and 2, a heat exchanger or condenser assembly is shown and generally identified at reference 10. The condenser assembly 10 generally includes a condenser 12, an input block 14, and a jumper tube assembly 20. The jumper tube assembly 20 generally includes a first connector block 24, a second connector block 26 and a jumper tube 30. Locating studs 31 extend from the input block 14 and the second connector block 26 for locating the A/C plumbing to the input block 14 and the second connector block 26.

Figure 3:
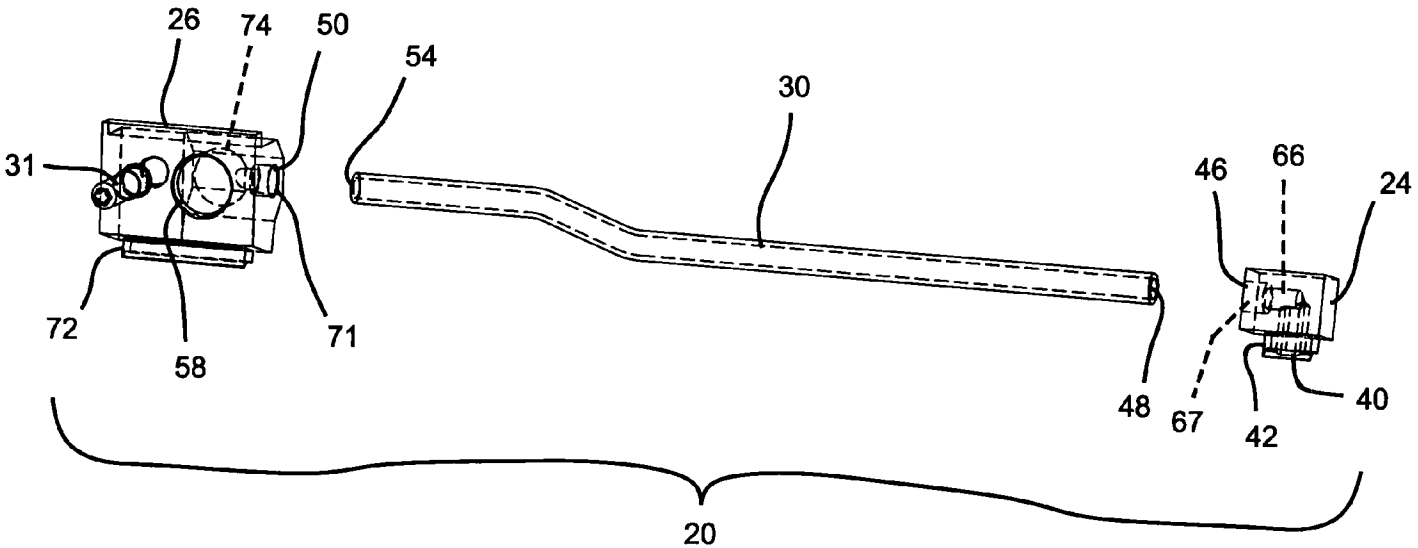
FIG. 3 is an exploded view of the jumper tube assembly.
Figure 4:
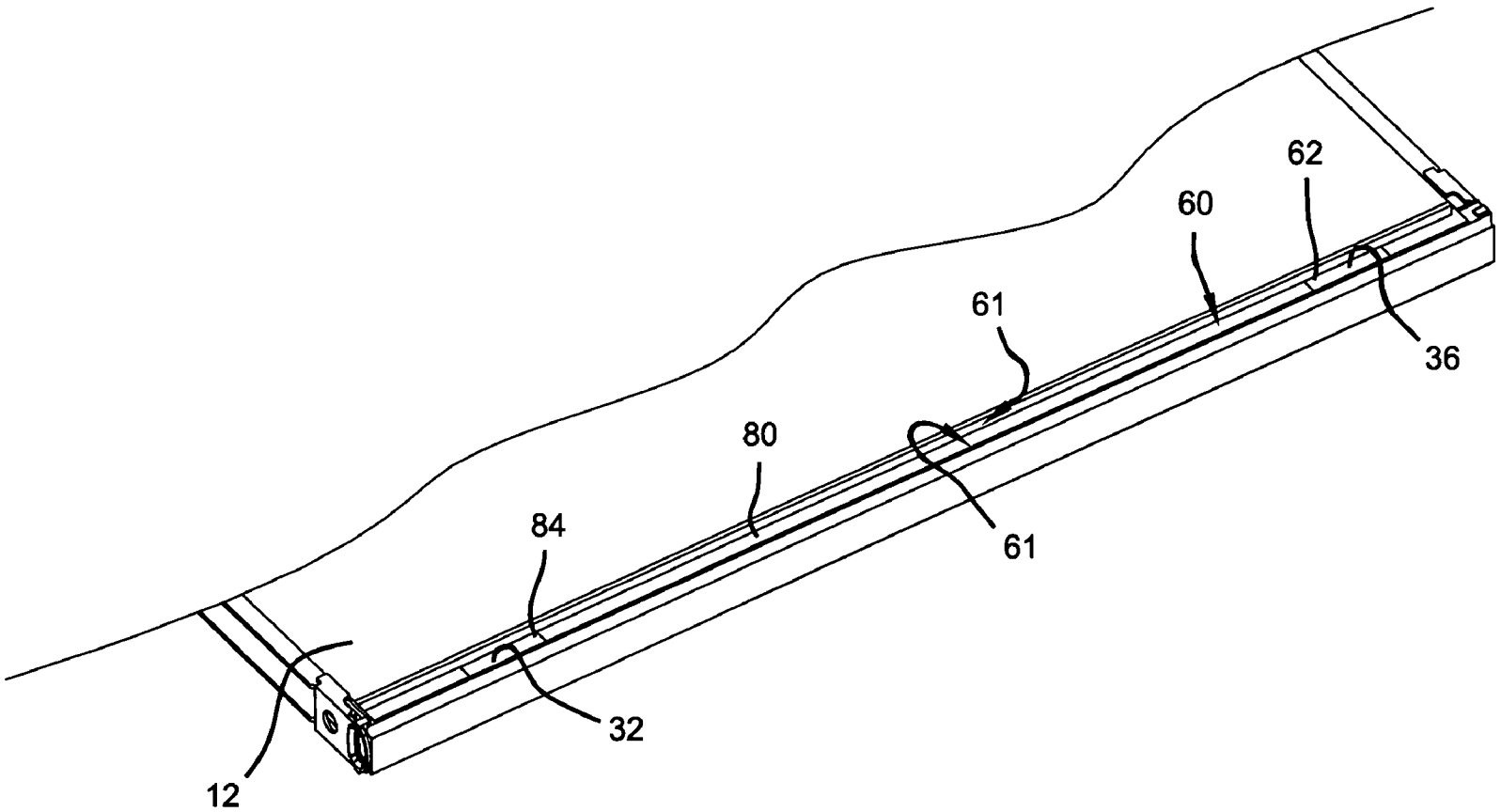
FIG. 4 is a perspective view of the condenser shown with the jumper tube assembly removed to illustrate the attachment area of the condenser.

With continued reference to FIGS. 1 and 2 and further reference to FIGS. 3 and 4, the jumper tube assembly will be further described. In a refrigeration cycle a compressor (not shown) discharges a superheated gas refrigerant of high temperature and high pressure, which flows into the condenser 12 at a condenser inlet 32 (FIG. 4) by way of an inlet 34 on the input block 14. Here, heat exchange is performed with the outside air sent by a cooling fan (not shown), so that the refrigerant is cooled and condensed. Condensed refrigerant flows from the condenser 12 through the jumper tube assembly 20. More specifically, condensed refrigerant exits the condenser 12 at an outlet 36 (FIG. 4) formed thereon. The first connector block 24 attached at the outlet 36 receives the refrigerant at an inlet 40 formed on an attachment portion or neck 42. Refrigerant exits the first connector block 24 at an outlet 46. The first connector block 24 is configured such that the inlet 40 and the outlet 46 form a right angle.

The refrigerant enters an inlet 48 of the jumper tube 30 fluidly connected at the outlet 46 of the first connector block 24. The jumper tube 30 carries the refrigerant to an inlet 50 incorporated on the second connector block 26. Fluid exits the jumper tube 30 at an outlet 54 fluidly connected to the input 50 of the second connector block 26. Fluid exits the second connector block 26 at an outlet 58. The refrigerant condensed in the condenser then flows from the second connector block 26 to another portion of the A/C system.

As will be described in greater detail, the components of the jumper tube assembly 20 are joined together by a brazing process. In a first method, the jumper tube assembly 20 is brazed together as a subassembly and subsequently brazed to the condenser 12. In a second method the first and second connector blocks 24 and 26 respectively, are brazed to the jumper tube 30 and the condenser 12 concurrently. The brazing processes employed herein allow the jumper tube assembly 20 to be mated to the condenser 12 without supplemental brackets or fasteners.

Figure 5:
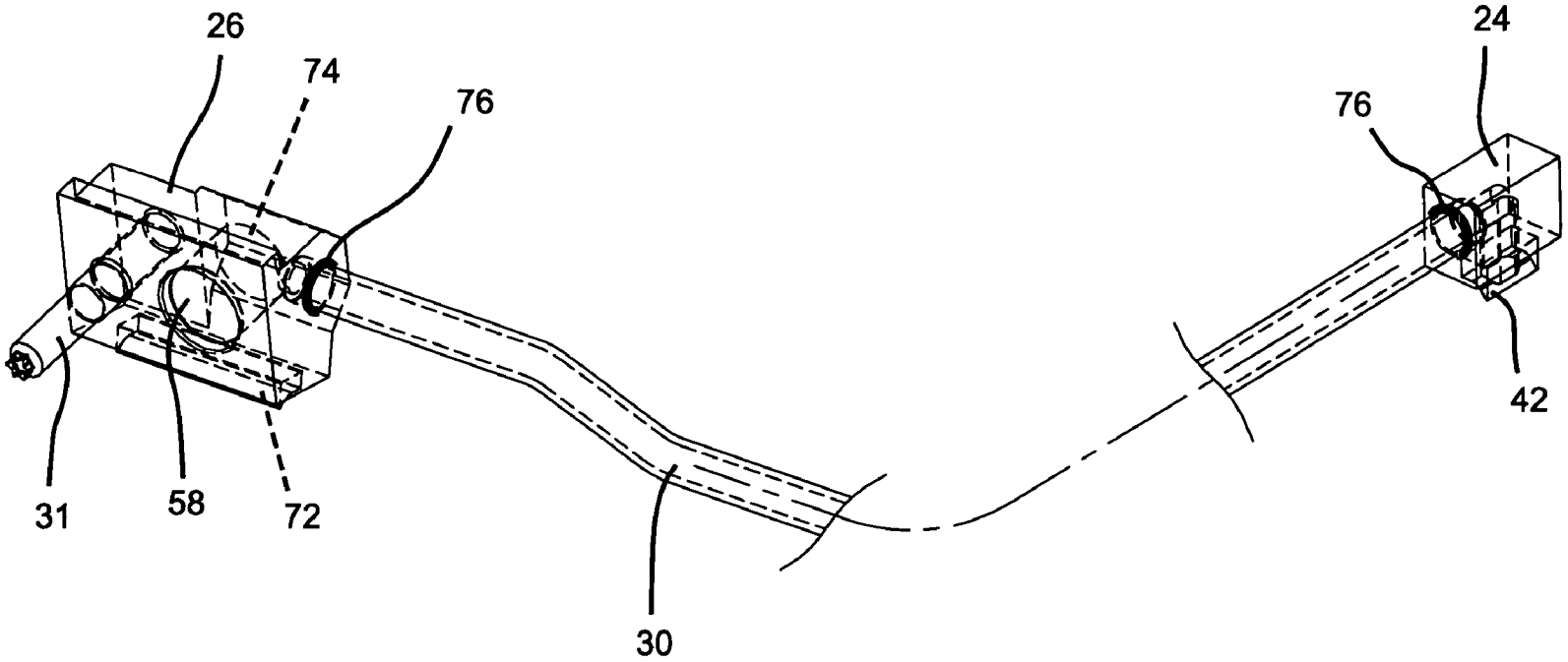
FIG. 5 is a perspective view of the jumper tube assembly shown with the jumper tube inserted into respective connector blocks.

With reference now to FIGS. 3–5, the jumper tube assembly 20 will be described in greater detail. The neck portion 42 of the first connector block 24 locates between a channel 60 defined by opposing walls 61 at locations longitudinally extending across the condenser 12 and aligning with a receiving portion 32 and the outlet 62 of the condenser 12. A passage 66 forming a right angle leads to a bore 67 for receiving the inlet 48 of the jumper tube 30 (FIG. 3).

The second connector block 26 includes a bore 71 for receiving the outlet 54 of the jumper tube 30. An attachment portion or neck 72 extends from the second connector block 26 for locating into the channel 60. A passage 74 forming a right angle connects the inlet 50 with the outlet 58 of the second connector block 26.

Figure 7:
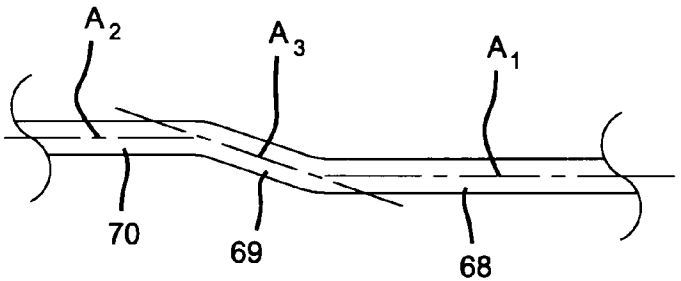
FIG. 7 is a partial plan view of the jumper tube.

Referring now to FIGS. 3 and 7, the jumper tube 30 generally includes an upstream portion 68, an intermediate portion 69 and a downstream portion 70. The jumper tube inlet 48 defines a first axis $A_1$ extending along the upstream portion 68. The jumper tube outlet 54 defines a second axis $A_2$ extending along the downstream portion 70. The intermediate portion 69 defines a third axis $A_3$. The first axis $A_1$ and the second axis $A_2$ are substantially parallel with the first axis $A_1$ offset toward the condenser 12. The right angle orientation of the first connector block 24 allows the upstream portion 68 of the jumper tube 30 to be oriented closely to the condenser 12. Moreover, the jumper tube does not require any bending or manipulation near its inlet 48 at the outlet 36 (FIG. 4) of the condenser 12. The location of the intermediate portion 69 is controlled by application. For example, the intermediate portion 69 may be formed in a location toward the downstream portion 70 for providing greater clearance proximate to the jumper tube 30.

With further reference to FIG. 5, a first method for assembling the jumper tube assembly 20 and the condenser 12 will now be described. In the first method, the jumper tube assembly 20 is brazed together as a subassembly before mating with the condenser 12. The inlet 48 of the jumper tube 30 is inserted into the bore 67 of the first connector block 24 and the outlet 54 of the jumper tube 30 is inserted into the bore 71 of the second connector block 26. Next, the jumper tube assembly 20 may be temporarily held together by deforming respective connector blocks 24 and 26 into the jumper tube 30 at respective ends of the upstream portion 68 and the downstream portion 70 forming a compression fit thereat. Brazing material 76 is then applied at the interface between the jumper tube 30 and the first and second connector blocks 24 and 26, respectively. The jumper tube 30 is then brazed to the first and second connector blocks 24 and 26, respectively, using conventional brazing techniques such as furnace or hand brazing. The brazed jumper tube 30 and connector blocks 24 and 26, respectively, define the jumper tube assembly 20.

Referring now to FIGS. 4–6B, the jumper tube assembly 20 is then located onto the channel 60 of the condenser 12. The steps of locating a connector block with respect to passages in a channel along a condenser are set forth in commonly owned U.S. Pat. No. 6,293,011, the teachings of which are incorporated herein by reference. The condenser outlet 36 is aligned with the inlet 40 of the first connector block 24. The neck 72 of the second connector block 26 is located onto a receiving portion 80 of the channel 60. Next, the opposing walls 61 of the channel 60 may be deflected toward each other thereby clamping the respective necks 42 and 72 of the connector blocks 24 and 26.

Figure 6A:
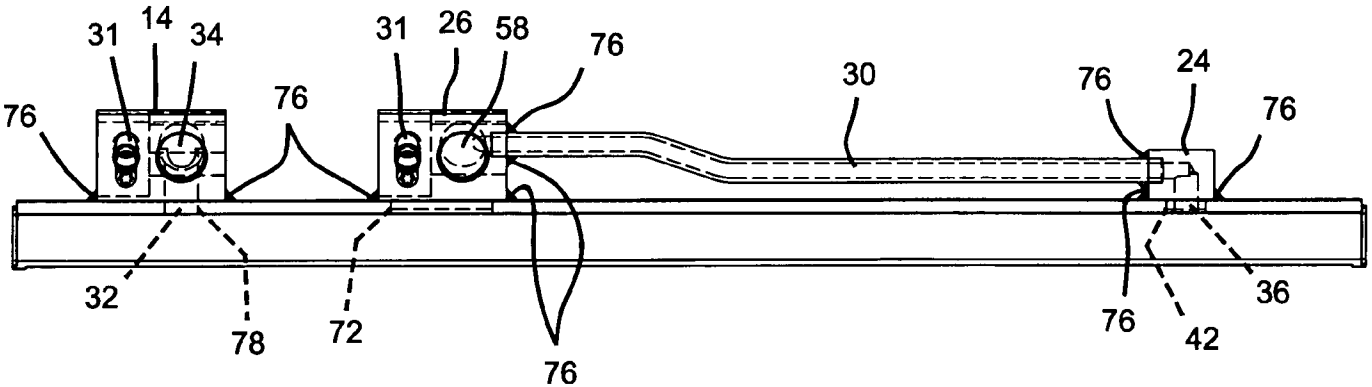
FIG. 6A is a plan view of the condenser assembly shown with the jumper tube assembly brazed to the condenser.

Once the jumper tube assembly 20 is properly located in the channel 60, brazing material 76 is then disposed at the interface of the first connector block 24 and the condenser 12 (FIG. 6A). Similarly, brazing material 76 is applied to the interface of the second connector block 26 and the condenser 12, as well as the interface of the input block 14 and the condenser 12. While the brazing material 76 is shown disposed around the outer boundaries of respective blocks 14, 24 and 26, it is appreciated that the brazing material 76 may additionally or alternatively be placed at other locations on the blocks 14, 24 and 26. For example, brazing material 76 may be incorporated around a neck 78 of the input block 14 and respective necks 42 and 72 of the first and second connector blocks 24 and 26. The entire assembly 10 is subsequently brazed through a heat application such as through a furnace.

Figure 6B:
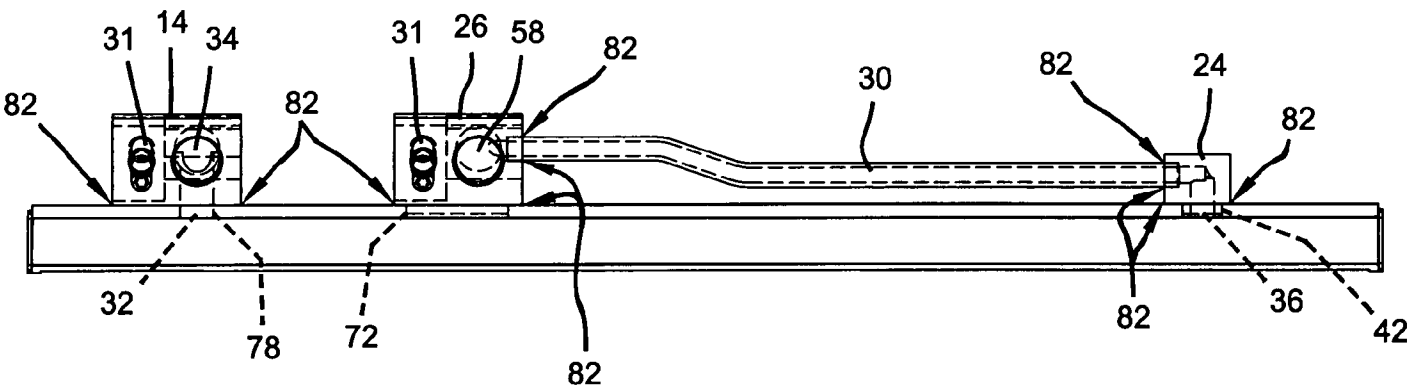
FIG. 6B is a plan view of the condenser assembly shown with the jumper tube assembly temporarily coupled to the condenser.

With reference now to FIGS. 6A and 6B, a second method for assembling the jumper tube assembly 20 and the condenser 12 will now be described. In the second method, the component interfaces identified for brazing are all brazed concurrently. Initially, the jumper tube assembly is held together by deforming respective first and second connector blocks 24 and 26 into the jumper tube 30 at respective ends of the upstream portion 68 and the downstream portion 70 (identified at reference 82, FIG. 6B).

The first and second connector blocks 24 and 26, respectively, are then located onto the condenser 12 in the desired location at respective receiving portions 62 and 80. The jumper tube 30 extends between the connector blocks 24 and 26. The connector blocks 24 and 26 are temporarily held to the condenser 12 by deforming the opposing walls 61 toward each other thereby clamping the respective necks 42 and 72 of the connector blocks 24 and 26 to keep the components within a toleranced position (identified at reference 82, FIG. 6B). It is appreciated that assembling the jumper tube 30 to the respective blocks 24 and 26 by compression fit may be performed as a separate subassembly or concurrently while deforming the outer walls 61 to clamp the connector blocks 24 and 26 to the condenser 12.

Brazing material 76 is then applied at the component intersection locations as described above (FIG. 6A). The entire assembly of condenser 12 and jumper tube assembly 20 is subsequently brazed through a heat application such as a furnace.

Those skilled in the art will readily appreciate that while the respective blocks 14, 24 and 26 are described as being temporarily held to the condenser 12 by deforming the opposing walls 61, other methods of temporarily fixing the connector blocks 14, 24 and 26 may be employed. Likewise, while the respective blocks 24 and 26 are described as temporarily clamping the jumper tube 30 by compression fit, other methods may be employed. For example, mechanical or chemical coupling material such as, but not limited to, wire wrapping may be placed in any location sufficient to temporarily couple the jumper tube 30 to the connector blocks 24 and 26 and temporarily couple the connector blocks 24 and 26 to the condenser 12. Furthermore, the bores 67 and 71 of respective first and second connector blocks 24 and 26 may be configured to receive respective ends of the jumper tube 30 as an interference fit, without the need to form a compression fit. Likewise, the walls 61 of the channel 60 may present an interference fit for receiving the respective connector blocks 24 and 26.

It is appreciated that the input block 14 may be located onto a receiving portion 84 of the condenser 12 and brazed to the condenser in the first and second method during the final heat or furnace application.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A jumper tube assembly for a heat exchanger comprising:

an inlet block, said inlet block located proximate a top edge for delivering refrigerant to an area within the heat exchanger below said inlet block;

a first connector block having an attachment portion engaged to the heat exchanger, an outlet and an inlet for receiving refrigerant from the heat exchanger;

a second connector block having an attachment portion engaged to the heat exchanger, an inlet and an outlet; and a jumper tube extending between said first and second connector block, said jumper tube having an inlet connected to said outlet of said first connector block and an outlet connected to said inlet of said second connector block;

wherein said jumper tube inlet defines a first axis and said jumper tube outlet defines a second axis, wherein said first axis is substantially parallel to said second axis, and wherein said inlet block, said first connector block and said second connector block are vertically aligned along an edge on a side of the heat exchanger through which air passes, and wherein the first connector block, second connector block, and jumper tube form a brazed structure that is itself brazed to the heat exchanger.

2. The jumper tube assembly of claim 1 wherein said jumper tube inlet defines a first axis and said jumper tube outlet defines a second axis, wherein said first axis and said second axis are laterally offset.

3. The jumper tube assembly of claim 2 wherein said jumper tube includes an upstream portion extending along said first axis for carrying refrigerant away from said first connector block.

4. The jumper tube assembly of claim 3 wherein said jumper tube includes a downstream portion extending along a second axis for carrying fluid to said second connector block.

5. The jumper tube assembly of claim 4 wherein said jumper tube includes an intermediate portion extending between said upstream and downstream portions, said intermediate portion defining an intermediate axis intersecting said first and second axis.

6. The jumper tube assembly of claim 5 wherein said upstream portion is offset from said downstream portion toward the heat exchanger.

7. The jumper tube assembly of claim 1 wherein said jumper tube inlet and jumper tube outlet are brazed to respective first and second connector blocks.

8. The jumper tube assembly of claim 1 wherein said first and second connector blocks are brazed to the heat exchanger.

9. The jumper tube assembly of claim 1 wherein said attachment portion includes a neck portion bounded by a channel extending on the heat exchanger, said inlet of said first connector block formed in said neck and aligned with an outlet on the heat exchanger.

10. A jumper tube assembly for a heat exchanger comprising:

an inlet block, said inlet block located proximate a top edge for delivering refrigerant to an area within the heat exchanger below said inlet block;

a first connector block interfacing with the heat exchanger for receiving gas refrigerant from the heat exchanger;

a second connector block interfacing with the heat exchanger for expelling the gas refrigerant received from the first connector block; and a jumper tube interposed between and interfacing with the first connector block and the second connector block, the jumper tube delivering the gas refrigerant from the first connector block to the second connector block, the jumper tube further comprising:

a first longitudinal axis of an upstream section connected to the first connector block;

a second longitudinal axis of a downstream section connected to the second connector block; and a third longitudinal axis of an intermediate section located between the upstream section and the downstream section, and wherein said inlet block, said first connector block and said second connector block are vertically aligned along an edge on a side of the heat exchanger through which air passes, and wherein the first connector block, second connector block, and jumper tube form a brazed structure that is itself brazed to the heat exchanger.

11. The jumper tube assembly of claim 10, further comprising:

an approximately parallel relationship between the first longitudinal axis of the upstream section and the second longitudinal axis of the downstream section.

12. The jumper tube assembly of claim 11, further comprising:

a brazed connection at each of the interfaces: between the first connector and the heat exchanger, between the second connector and the hear exchanger, between the jumper tube and the first connector, and between the jumper tube and the second connector.

13. The jumper tube assembly of claim 12, the first connector block further defining:

a first bored hole; and a second bored hole, wherein axis of the bored holes meet at 90 degrees to permit the gas refrigerant to flow from the heat exchanger and then parallel to a surface of the heat exchanger having the brazed connections, via the jumper tube en route to the second connector block.

14. A jumper tube assembly for a heat exchanger comprising:

an inlet block, said inlet block located proximate a top edge for delivering refrigerant to an area within the heat exchanger below said inlet block;

a first connector block interfacing with the heat exchanger for receiving gas refrigerant from the heat exchanger;

a second connector block interfacing with the heat exchanger for expelling the gas refrigerant received from the first connector block; and a jumper tube interposed between and interfacing with the first connector block and the second connector block, the jumper tube delivering the gas refrigerant from the first connector block to the second connector block, the jumper tube further comprising:

a first longitudinal axis of an upstream section connected to the first connector block, wherein the upstream section is located closest to the heat exchanger to facilitate heat exchanger installation in small spaces;

a second longitudinal axis of a downstream section connected to the second connector block; and a third longitudinal axis of an intermediate section located between the upstream section and the downstream section, wherein said inlet block, said first connector block and said second connector block are vertically aligned along an edge on a side of the heat exchanger through which air passes, and wherein the first connector block, second connector block, and jumper tube form a brazed structure that is itself brazed to the heat exchanger.

15. The jumper tube assembly of claim 14, the first connector block further defining:

a hole bored through the first connector block at 90 degrees, the hole permitting the gas refrigerant to flow from the heat exchanger and into the jumper tube upstream section, the jumper tube upstream section being parallel to a surface of the heat exchanger having the brazed connections.

16. The jumper tube assembly of claim 14, further comprising:

a brazed connection at each of the interfaces: between the first connector and the heat exchanger, between the second connector and the hear exchanger, between the jumper tube and the first connector, and between the jumper tube and the second connector; and an approximately parallel relationship between the first longitudinal axis of the upstream section and the second longitudinal axis of the downstream section.

* * * * *